US009979071B2

(12) United States Patent
Hsieh et al.

(10) Patent No.: US 9,979,071 B2
(45) Date of Patent: May 22, 2018

(54) ELECTRONIC DEVICE

(71) Applicant: Acer Incorporated, New Taipei (TW)

(72) Inventors: Cheng-Yu Hsieh, New Taipei (TW); Kun-Sheng Chang, New Taipei (TW); Ching-Chi Lin, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days. days.

(21) Appl. No.: 15/096,053

(22) Filed: Apr. 11, 2016

(65) Prior Publication Data

US 2017/0141452 A1 May 18, 2017

(30) Foreign Application Priority Data

Nov. 13, 2015 (TW) ..... 104137449 A

(51) Int. Cl.

| | |
|---|---|
| ***H01Q 1/38*** | (2006.01) |
| ***H01Q 1/22*** | (2006.01) |
| ***H01Q 1/52*** | (2006.01) |
| ***H01Q 9/04*** | (2006.01) |
| ***H01Q 1/24*** | (2006.01) |
| ***H01Q 1/48*** | (2006.01) |
| ***H01Q 9/42*** | (2006.01) |

(52) U.S. Cl.

CPC ..... *H01Q 1/22* (2013.01); *H01Q 1/243* (2013.01); *H01Q 1/38* (2013.01); *H01Q 1/48* (2013.01); *H01Q 1/528* (2013.01); *H01Q 9/0414* (2013.01); *H01Q 9/0421* (2013.01); *H01Q 9/42* (2013.01)

(58) Field of Classification Search

CPC ..... H01Q 1/22; H01Q 1/528; H01Q 9/0421; H01Q 9/0414

USPC ..... 343/700 MS, 702

See application file for complete search history.

(56) References Cited

U.S. PATENT DOCUMENTS 6,133,880 A * 10/2000 Grangeat ..... H01P 5/08 343/700 MS
7,321,333 B2 * 1/2008 Tsai ..... H01Q 1/38 343/700 MS
7,321,335 B2 * 1/2008 Egorov ..... H01Q 1/243 343/700 MS

FOREIGN PATENT DOCUMENTS

TW 200830630 7/2008

* cited by examiner

*Primary Examiner* — Daniel J Munoz
*Assistant Examiner* — Hai Tran
(74) *Attorney, Agent, or Firm* — J.C. Patents

(57) ABSTRACT

An electronic device including a metal element and an antenna element is provided. The antenna element is disposed on a substrate and includes a radiation portion and a connection portion. A first end of the radiation portion has a feeding point for receiving a feeding signal, and a second end of the radiation portion is an open end. A first end of the connection portion is electrically connected to the first end of the radiation portion. A second end of the connecting portion has a first ground point to be electrically connected the metal element. An orthogonal projection of the metal element on the substrate and an orthogonal projection of the antenna element on the substrate are overlapped with each other. The radiation portion is electrically connected the metal element through a second ground point.

12 Claims, 5 Drawing Sheets

ELECTRONIC DEVICE

CROSS-REFERENCE TO RELATED APPLICATION

This application claims the priority benefit of Taiwan application Ser. No. 104137449, filed on Nov. 13, 2015. The entirety of the above-mentioned patent application is hereby incorporated by reference herein and made a part of this specification.

BACKGROUND OF THE INVENTION

Field of the Invention

The invention is related to an electronic device, and particularly related to an electronic device having a metal element and an antenna element.

Description of Related Art

In recent years, electronic devices with metal touch are getting popular with consumers. Accordingly, most current electronic devices are designed with a metal back cover or a metal frame to exhibit uniqueness and appearance characteristics of the products. In addition, the electronic device is provided with an antenna element; the coupling between the antenna element and the metal back cover affects radiation characteristic of the antenna element.

To reduce the effect of the metal back cover on the antenna element, in conventional techniques, the antenna element is generally disposed to be away from the metal back cover. For example, in conventional techniques, a distance between the antenna element and the metal back cover needs to be larger than 5 mm or more. However, under the circumstances where the distance between the antenna element and the metal back cover is larger, the thickness of the electronic device increases relatively, making it difficult to achieve slim design of the electronic device.

SUMMARY OF THE INVENTION

The invention is directed to an electronic device in which an antenna element has a feeding point and a first ground point, and a radiation portion of the antenna element has a second ground point. Accordingly, with arrangement of the second ground point, the effect of metal element on the antenna element can be effectively reduced, thereby facilitating slim design of the electronic device.

In an embodiment of the invention, the electronic device includes a metal element and an antenna element. The antenna element is disposed on a substrate and includes a radiation portion and a connecting portion. A first end of the radiation portion has a feeding point for receiving a feeding signal. A second end of the radiation portion is an open end. A first end of the connecting portion is electrically connected to the first end of the radiation portion. A second end of the connecting portion has a first ground point to be electrically connected to the metal element. Furthermore, an orthogonal projection of the metal element on the substrate and an orthogonal projection of the antenna element on the substrate are overlapped with each other. The radiation portion is electrically connected to the metal element via the second ground point.

In an embodiment of the invention, the electronic device further includes a ground element. The ground element is electrically connected to the first ground point and the metal element. The radiation portion includes a first radiation arm and a second radiation arm that are electrically connected together. The first radiation arm is adjacent to an edge of the ground element, and the second radiation arm is parallel with the edge of the ground element.

In an embodiment of the invention, the feeding point is disposed in the first radiation arm, and the second ground point is disposed in the second radiation arm.

Based on the above, in the electronic device of the invention, the orthogonal projection of the metal element on the substrate and the orthogonal projection of the antenna element on the substrate are overlapped with each other. Meanwhile, the radiation portion of the antenna element receives the feeding signal via the feeding point, and the connecting portion of the antenna element is electrically connected to the metal element via the first ground point. Moreover, the radiation portion of the antenna element further has the second ground point that is electrically connected to the metal element. With such configuration, the effect of the metal element on the antenna element can be effectively reduced, thereby facilitating slim design of the electronic device.

In order to make the aforementioned features and advantages of the invention more comprehensible, embodiments accompanying figures are described in detail below.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DESCRIPTION OF THE EMBODIMENTS

Figure 1:
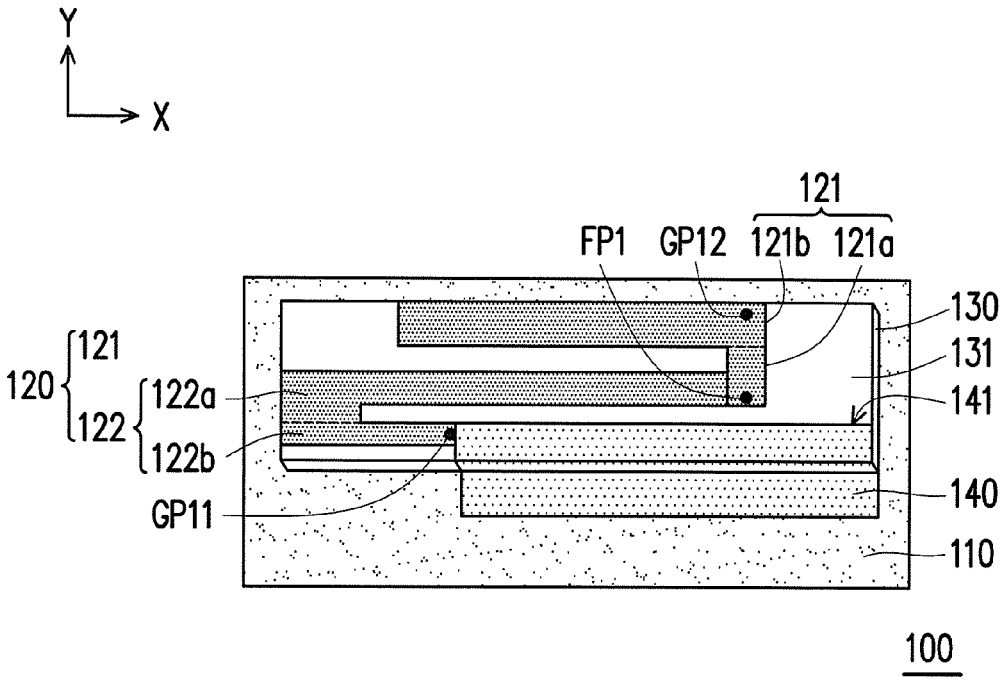
FIG. 1 is a schematic view illustrating an electronic device according to an embodiment of the invention.

FIG. 1 is a schematic view illustrating an electronic device according to an embodiment of the invention. As shown in FIG. 1, an electronic device 100 includes a metal element 110, an antenna element 120 and a substrate 130, and the antenna element 120 includes a radiation portion 121 and a connecting portion 122. The metal element 110 may be, for example, a metal back cover or a portion of the metal back cover of the electronic device 100. The antenna element 120 is disposed on the substrate 130, and the substrate 130 is disposed on the metal element 100. In other words, the antenna element 120 and the metal element 110 are spaced apart by the substrate 130, and the antenna element 120 is opposite to the metal element 110. In addition, an orthogonal projection of the metal element 110 on the substrate 130 and an orthogonal projection of the antenna element 120 on the substrate 130 are overlapped with each other.

In terms of the antenna element 120, a first end of the radiation portion 121 has a feeding point FP1 for receiving a feeding signal, and a second end of the radiation portion 121 is an open end. A first end of the connecting portion 122 is electrically connected to the first end of the radiation portion 121. A second end of the connecting portion 122 has a first ground point GP11 to be electrically connected to the metal element 110. For example, the electronic device 100 further includes a ground element 140, and the first ground point GP11 of the connecting portion 122 may be electrically connected to the metal element 110 via the ground element 140. With such configuration, the radiation portion 121 and the connecting portion 122 may form an inverted F antenna. That is to say, the antenna element 120 may be, for example, an inverted F antenna that can operate in a first band (e.g. 2.4 GHz).

Figure 2:
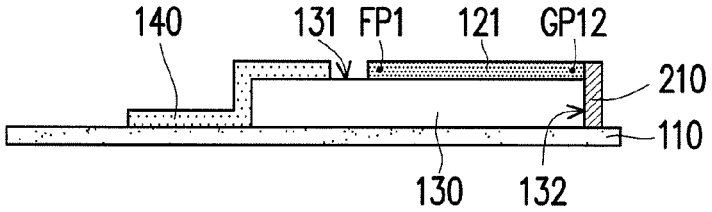
FIG. 2 is a sectional view illustrating the electronic device in FIG. 1 in a Y-axis direction.

It should be noted that the radiation portion 121 of the antenna element 120 further has a second ground point GP12, and the radiation portion 121 is electrically connected to the metal element 110 via the second ground point GP12. For example, FIG. 2 is a sectional view illustrating the electronic device in FIG. 1 in a Y-axis direction. As shown in FIG. 2, the electronic device 100 further includes a conductive element 210. The substrate 130 includes a surface 131 and a side wall 132 that are adjacent to each other. The antenna element 120 is disposed on the surface 131 of the substrate 130, and the conductive element 210 is attached to the side wall 132 of the substrate 130. In addition, the conductive element 210 is electrically connected between the second ground point GP12 of the radiation portion 121 and the metal element 110.

Figure 3:
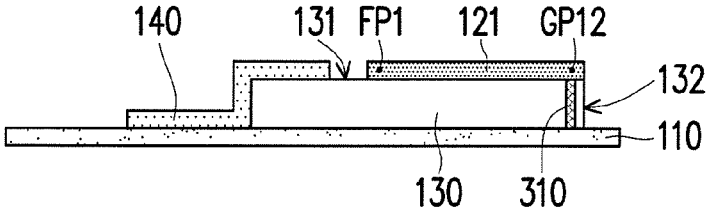
FIG. 3 is another sectional view illustrating the electronic device in FIG. 1 in the Y-axis direction.

The conductive element 210 may be, for example, a metal sheet, a conductive elastic piece or a pogo-pin. Although FIG. 2 exemplifies how the radiation portion 121 and the metal element 110 are connected to each other, it should not be construed as a limitation to the invention. For example, FIG. 3 is another sectional view illustrating the electronic device in FIG. 1 in the Y-axis direction. As shown in FIG. 3, the electronic device 100 further includes a conductive element 310 that may be, for example, a conductive through hole. Specifically, the conductive through hole penetrates through the substrate 130, and the conductive through hole is electrically connected between the second ground point GP12 of the radiation portion 121 and the metal element 110.

In terms of operation, the antenna element 120 can receive the feeding signal generated by a transceiver (not shown) in the electronic device 100 via the feeding point FP1. Accordingly, with excitation of the feeding signal, the antenna element 120 can operate in a first band (e.g. 2.4 GHz). It should be pointed out that, since the radiation portion 121 of the antenna element 120 has the second ground point GP12, the effect of the metal element 110 on the antenna element 120, namely, the mutual interference between the metal element 110 and the antenna element 120, can be effectively reduced.

Figure 4:
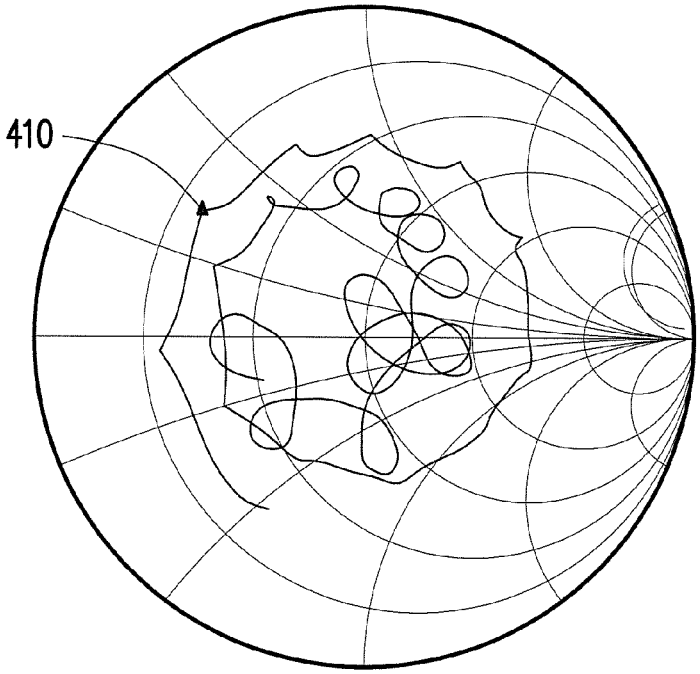
FIG. 4 is a Smith Chart illustrating an antenna element without a second ground point according to an embodiment of the invention.
Figure 5:
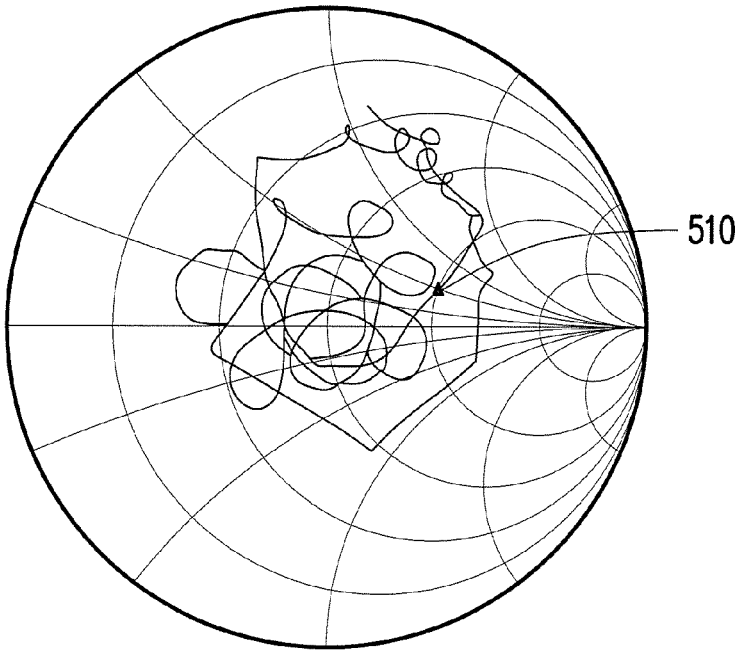
FIG. 5 is a Smith Chart illustrating an antenna element having a second ground point according to an embodiment of the invention.
Figure 6:
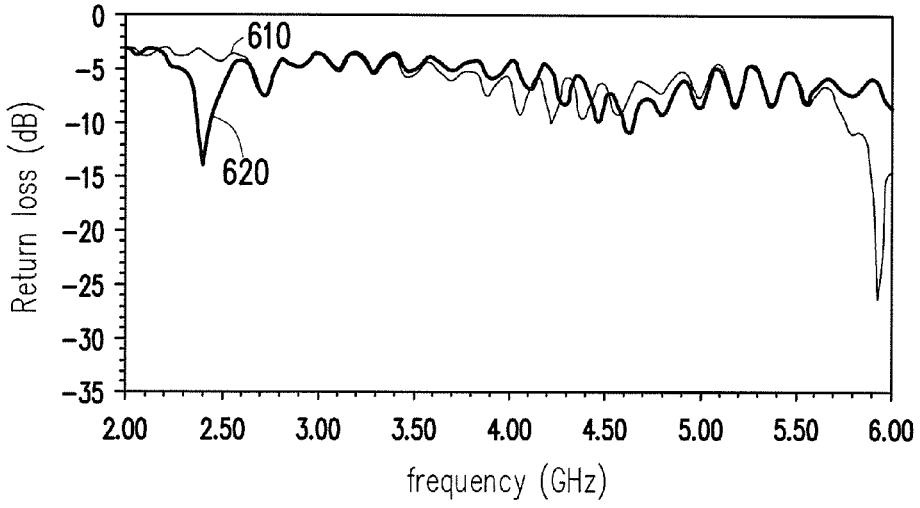
FIG. 6 is a diagram showing a return loss of an antenna element with or without a second ground point according to an embodiment of the invention.

For example, FIG. 4 is a Smith Chart illustrating an antenna element without a second ground point according to an embodiment of the invention. FIG. 5 is a Smith Chart illustrating an antenna element having a second ground point according to an embodiment of the invention. FIG. 6 is a diagram showing a return loss of an antenna element with or without a second ground point according to an embodiment of the invention. As indicated by an impedance point 410 in FIG. 4, under the condition that the second ground point GP12 is not disposed, an impedance of the antenna element 120 in the first band (e.g. 2.4 GHz) is located in an inductive region, and an inductive component of the impedance of the antenna element 120 is high. At this time, as indicated by a return loss curve 610 in FIG. 6, the antenna element 120 cannot generate a good resonant mode in the first band (e.g. 2.4 GHz).

On the other hand, as shown by an impedance point 510 in FIG. 5, with arrangement of the second ground point GP12, a capacitive component of the impedance of the antenna element 120 increases correspondingly. Therefore, the impedance of the antenna element 120 in the first band (e.g. 2.4 GHz) is close to 50 ohm. At this time, as indicated by a return loss curve 620 in FIG. 6, the antenna element 120 can generate a good resonant mode in the first band (e.g. 2.4 GHz).

In other words, with the arrangement of the second ground point GP12, the effect of the metal element 110 on the antenna element 120 can be effectively reduced. That is, the arrangement of the second ground point GP12 can shorten the distance between the antenna element 120 and the metal element 110 (e.g. metal back cover), and helps to achieve slim design of the electronic device 100. For example, in an embodiment, the thickness of the substrate 130 may be less than or equal to 3 mm; that is, the distance between the antenna element 120 and the metal element 100 can be reduced to 3 mm at least.

In order to make the present invention comprehensive to those skilled in the art, an exemplary embodiment is described below which shows a detailed structure of the antenna element 120. Further referring to FIG. 1, a portion of the radiation portion 121 and a portion of the connecting portion 122 are parallel with an edge 141 of the ground element 140. Specifically, the radiation portion 121 includes a first radiation arm 121*a* and a second radiation arm 121*b* that are electrically connected to each other, and the connecting portion 122 includes a first connecting arm 122*a* and a second connecting arm 122*b* that are electrically connected to each other.

The first radiation arm 121*a* is adjacent to and perpendicular to the edge 141 of the ground element 140. The second radiation arm 121*b* is parallel with the edge 141 of the ground element 140. Accordingly, the first radiation arm 121*a* and the second radiation arm 121*b* may be formed as an L-shape structure. In other words, the radiation portion 121 includes a bending, and the shape of the radiation portion 121 may be, for example, an L-like shape. Although FIG. 1 exemplifies the implementation of the radiation portion 121, it should not be construed as a limitation to the invention. For instances, in another embodiment, the second radiation arm 121*b* may be, for example, parallel with the first radiation arm 121*a*. That is to say, the shape of radiation portion 121 may be, for example, a straight-line shape.

It should be noted that the feeding point FP1 may be disposed at the first end of the radiation portion 121, and the second ground point GP12 may be disposed at the bending of the radiation portion 121. In addition, a distance between the second ground point GP12 to a second end (i.e., open end) of the radiation portion 121 is proportional to the frequency of the first band. In other words, under the condition that the second ground point GP12 is closer to the second end (i.e., open end) of the radiation portion 121, the frequency of the first band in which the antenna element 120 operates is higher. For example, in FIG. 1, the feeding point FP1 may be disposed on the first radiation arm 121*a*, and the second ground point GP12 may be disposed on the second radiation arm 121*b*. In addition, the distance between the second ground point GP12 and the second end (i.e., open end) of the radiation portion 121 may be, for example, ¼ wavelength of the lowest frequency of the first band.

In terms of the connecting portion 122 of the antenna element 120, the first connecting arm 122*a* is electrically connected to the first radiation arm 121*a*, and the first connecting arm 122*a* is disposed between the second radiation arm 121*b* and the edge 141 of the ground element 140. The second connecting arm 122*b* is electrically connected to the first connecting arm 122*a* and the ground element 140, and the second connecting arm 122*b* is parallel with the second radiation arm 121*b*. Viewing from another angle, the second connecting arm 122*b* and the ground element 140 are sequentially arranged along an X-axis direction, and the first connecting arm 122*a* faces the second connecting arm 122*b* and the edge 141 of the ground element 140. Moreover, the shape of the first connecting arm 122*a* may be, for example, an inverted L-shape. The shape of the second connecting arm 122*b* may be, for example, a straight-line shape. Accordingly, the radiation portion 121 and the first connecting arm 122*a* of the connecting portion 122 can form a groove with an opening facing the −X-axis direction, and the connecting portion 122 has another groove with an opening facing the X-axis direction.

It should be mentioned that the radiation portion 121 in FIG. 1 can form a resonant path, such that the antenna element 120 can operate in the first band via the radiation portion 121. In another embodiment, an adjusting portion may be further disposed in the antenna element 120, such that the antenna element 120 can further operate in a second band. In addition, a parasitic portion may be further disposed in the antenna element 120 so as to adjust the bandwidth of the second band in which the antenna element 120 operates.

Figure 7:
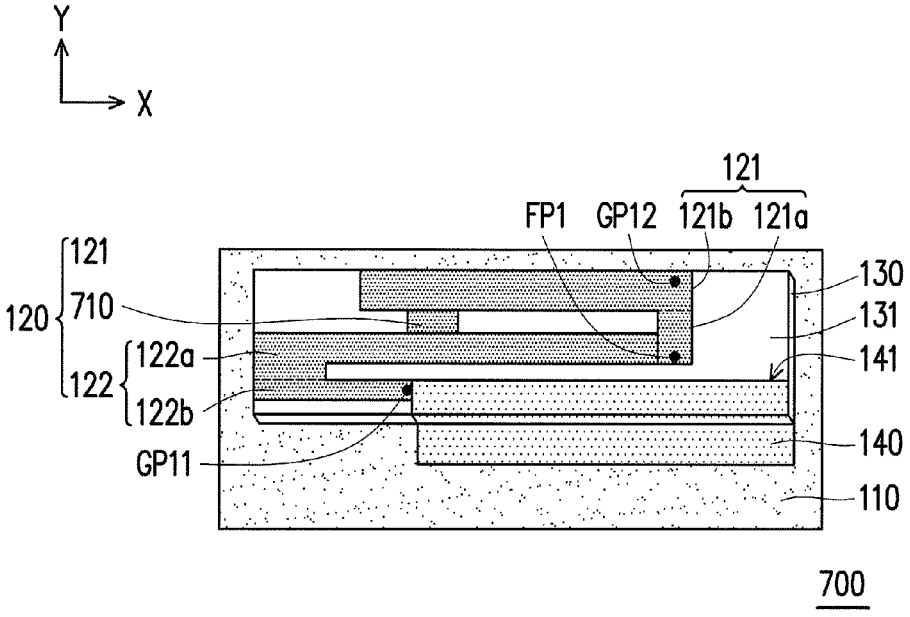
FIG. 7 is a schematic view illustrating an electronic device according to another embodiment of the invention.
Figure 8:
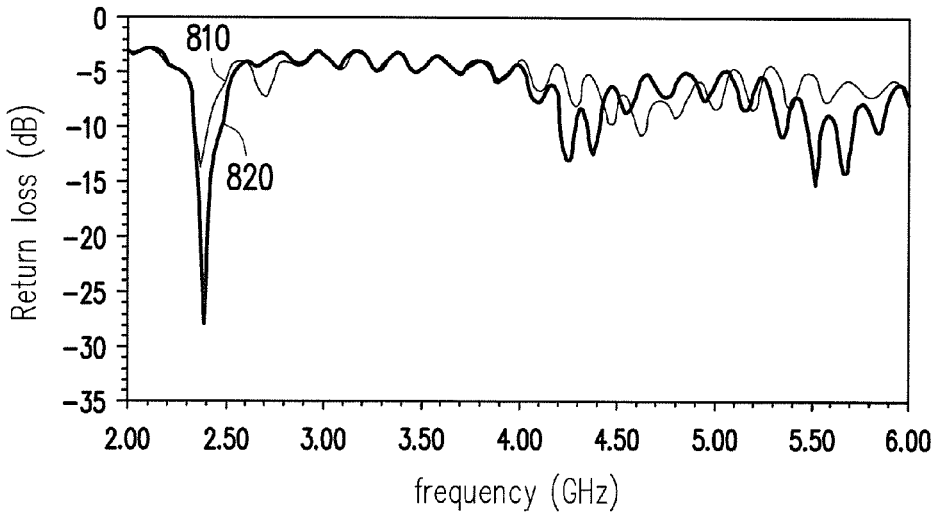
FIG. 8 describes the diagram showing the return loss of the antenna element in FIG. 7.

For example, FIG. 7 is a schematic view illustrating an electronic device according to another embodiment of the invention. Compared to the embodiment in FIG. 1, an electronic device 700 in FIG. 7 further includes an adjusting portion 710. Specifically, the adjusting portion 710 is electrically connected to the radiation portion 121 and the connecting portion 122. In other words, the adjusting portion 710 is electrically connected to the second radiation arm 121*b* and the first connecting arm in 122*a*. Moreover, a distance between the adjusting portion 710 and the first radiation arm 121*a* is larger than 1/10 wavelength of the lowest frequency of the first band. FIG. 8 describes the diagram showing the return loss of the antenna element in FIG. 7. A return loss curve 810 represents a return loss under the condition where the adjusting portion 710 is not incorporated into the antenna element 120; a return loss curve 820 represents a return loss under the condition where the adjusting portion 710 is incorporated into the antenna element 120. The return loss curves 810 and 820 show that the adjusting portion 710 is configured to increase the bandwidth of the first band (e.g. 2.4 GHz) of the antenna element 120. Apart from that, with the arrangement of the adjusting portion 710, the antenna element 120 can further operate in the second band (e.g. 5 GHz).

Figure 9:
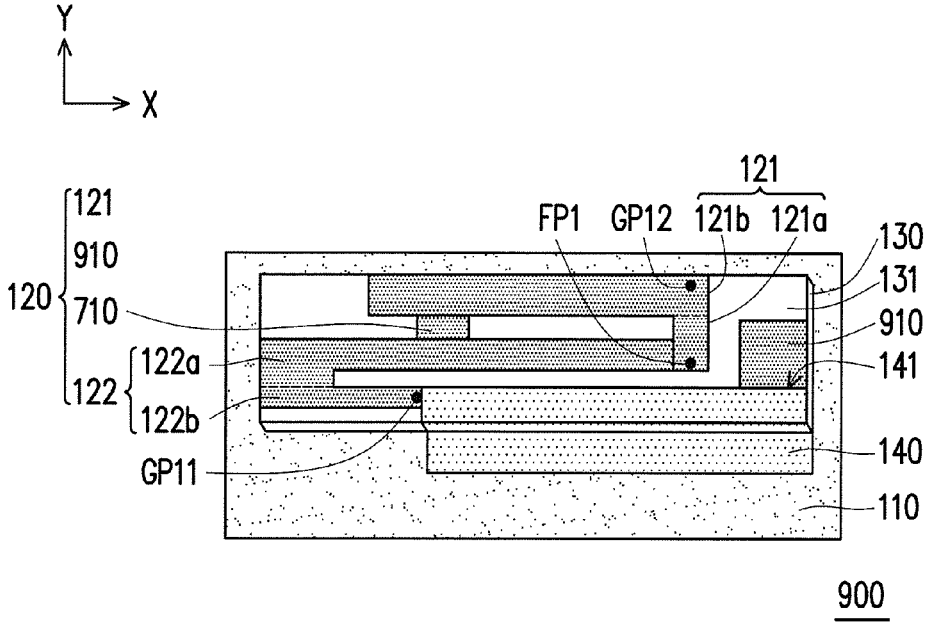
FIG. 9 is a schematic view illustrating an electronic device according to another embodiment of the invention.
Figure 10:
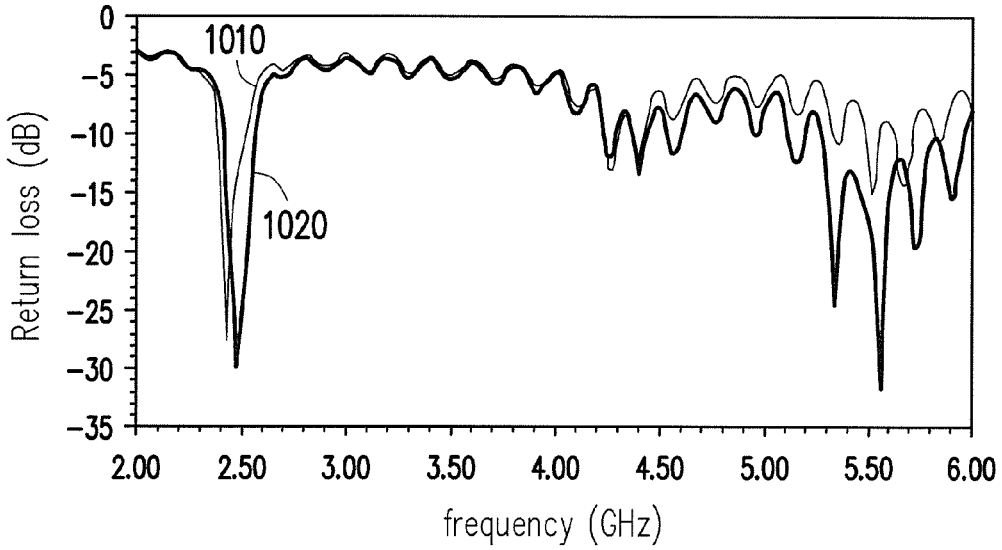
FIG. 10 describes the diagram showing the return loss of the antenna element in FIG. 9.

FIG. 9 is a schematic view illustrating an electronic device according to another embodiment of the invention. Compared to the embodiment in FIG. 7, an electronic device 900 illustrated by FIG. 9 further includes a parasitic portion 910. Specifically, the parasitic portion 910 is electrically connected to the edge 141 of the ground element 140, and the parasitic portion 910 faces the first radiation arm 121*a* of the radiation portion 121. Furthermore, the first radiation arm 121*a* is disposed between the parasitic portion 910 and the connecting portion 122. FIG. 10 describes the diagram showing the return loss of the antenna element in FIG. 9. A return loss curve 1010 represents a return loss under the condition that the parasitic portion 910 is not incorporated into the antenna element 120; a return loss curve 1020 represents a return loss under the condition that the parasitic portion 910 is incorporated into the antenna element 120. The return loss curves 1010 and 1020 show that the parasitic portion 910 is configured to increase the bandwidth of the second band (e.g. 5 GHz) of the antenna element 120, such that the frequency of the second band ranges from 5.15 GHz to 5.85 GHz.

Based on the above, in the electronic device of the invention, the orthogonal projection of the metal element on the substrate and the orthogonal projection of the antenna element on the substrate are overlapped with each other. Meanwhile, the radiation portion of the antenna element receives the feeding signal via the feeding point, and the connecting portion of the antenna element is electrically connected to the metal element via the first ground point. Furthermore, the radiation portion of the antenna element further has the second ground point that is electrically connected to the metal element. Accordingly, with the arrangement of the second ground point, the effect of metal element on the antenna element can be effectively reduced, thereby facilitating slim design of the electronic device.

Although the invention has been disclosed by the above embodiments, the embodiments are not intended to limit the invention. It will be apparent to those skilled in the art that various modifications and variations can be made to the structure of the invention without departing from the scope or spirit of the invention. Therefore, the protecting range of the invention falls in the appended claims.

What is claimed is:

1. An electronic device, comprising:

a metal element; and an antenna element, disposed on a substrate, and comprising:

a radiation portion, a first end of the radiation portion having a feeding point for receiving a feeding signal, and a second end of the radiation portion being an open end, wherein the radiation portion comprises a first radiation arm and a second radiation arm that are electrically connected to each other;

a connecting portion, a first end of the connecting portion being electrically connected to the first end of the radiation portion, and a second end of the connecting portion having a first ground point to be electrically connected to the metal element;

an adjusting portion; and a parasitic portion, wherein an orthogonal projection of the metal element on the substrate and an orthogonal projection of the antenna element on the substrate are overlapped with each other, a second ground point is disposed on the radiation portion to form a current path extending from the feeding point to the metal element via the second ground point, and the current path does not pass through the connecting portion, and the connecting portion further comprises a first connecting arm and a second connecting arm; and a ground element, electrically connected to the first ground point and the metal element, wherein the first radiation arm is adjacent to an edge of the ground element, and the second radiation arm is parallel with the edge of the ground element;

the first connecting arm electrically connected to the first radiation arm and disposed between the edge of the ground element and the second radiation arm;

the second connecting arm electrically connected to the first connecting arm and the ground element, and the second connecting arm being parallel with the second radiation arm;

the antenna element operates in a first band via the radiation portion, and the adjusting portion electrically connected to the second radiation arm and the first connecting arm to increase a bandwidth of the first band such that the antenna element further operates in a second band; and the parasitic portion electrically connected to the edge of the ground element and facing the first radiation arm, and the parasitic portion configured to increase a bandwidth of the second band.

2. The electronic device according to claim 1, wherein the feeding point is disposed on the first radiation arm, and the second ground point is disposed on the second radiation arm.

3. The electronic device according to claim 1, further comprising a conductive element, wherein the conductive element is disposed on the substrate or penetrates through the substrate, and the conductive element is electrically connected between the metal element and the second ground point of the radiation portion.

4. The electronic device according to claim 1, wherein the antenna element is an inverted F antenna.

5. An electronic device, comprising:

a metal element;

an antenna element, disposed on a substrate, and comprising:

a radiation portion, a first end of the radiation portion having a feeding point for receiving a feeding signal, and a second end of the radiation portion being an open end; and a connecting portion, a first end of the connecting portion being electrically connected to the first end of the radiation portion, and a second end of the connecting portion having a first ground point to be electrically connected to the metal element, wherein an orthogonal projection of the metal element on the substrate and an orthogonal projection of the antenna element on the substrate are overlapped with each other, and the radiation portion is electrically connected to the metal element via a second ground point; and a ground element, electrically connected to the first ground point and the metal element, wherein the radiation portion comprises a first radiation arm and a second radiation arm that are electrically connected to each other, the first radiation arm is adjacent to an edge of the ground element, the second radiation arm is parallel with the edge of the ground element, and the feeding point is disposed on the first radiation arm, and the second ground point is disposed on the second radiation arm.

6. The electronic device according to claim 5, wherein the connecting portion comprises:

a first connecting arm, electrically connected to the first radiation arm and disposed between the edge of the ground element and the second radiation arm; and a second connecting arm, electrically connected to the first connecting arm and the ground element, and the second connecting arm being parallel with the second radiation arm.

7. The electronic device according to claim 6, wherein the antenna element operates in a first band via the radiation portion, and the antenna element further comprises:

an adjusting portion, electrically connected to the second radiation arm and the first connecting arm to increase a bandwidth of the first band such that the antenna element further operates in a second band.

8. The electronic device according to claim 7, wherein the antenna element further comprises:

a parasitic portion, electrically connected to the edge of the ground element and facing the first radiation arm, and the parasitic portion configured to increase a bandwidth of the second band.

9. An electronic device, comprising:

a metal element; and an antenna element, disposed on a substrate, and comprising:

a radiation portion, a first end of the radiation portion having a feeding point for receiving a feeding signal, and a second end of the radiation portion being an open end, wherein the antenna element operates in a first band via the radiation portion;

a connecting portion, a first end of the connecting portion being electrically connected to the first end of the radiation portion, and a second end of the connecting portion having a first ground point to be electrically connected to the metal element, wherein an orthogonal projection of the metal element on the substrate and an orthogonal projection of the antenna element on the substrate are overlapped with each other, and the radiation portion is electrically connected to the metal element via a second ground point;

an adjusting portion, electrically connected to the radiation portion and the connecting portion to increase a bandwidth of the first band such that the antenna element further operates in a second band, wherein the connecting portion is electrically connected to the metal element via a ground element; and a parasitic portion, electrically connected to an edge of the ground element and facing the radiation portion, and the parasitic portion configured to increase a bandwidth of the second band, wherein a portion of the radiation portion and a portion of the connecting portion are parallel with the edge of the ground element.

10. The electronic device according to claim 9, wherein the radiation portion comprises a first radiation arm and a second radiation arm that are electrically connected to each other, the first radiation arm is adjacent to an edge of the ground element, and the second radiation arm is parallel with the edge of the ground element.

11. The electronic device according to claim 10, wherein the feeding point is disposed on the first radiation arm, and the second ground point is disposed on the second radiation arm.

12. The electronic device according to claim 10, wherein the connecting portion comprises:

a first connecting arm, electrically connected to the first radiation arm and disposed between the edge of the ground element and the second radiation arm; and a second connecting arm, electrically connected to the first connecting arm and the ground element, and the second connecting arm being parallel with the second radiation arm.

* * * * *